US010017958B1

(12) United States Patent
Frydrych

(10) Patent No.: US 10,017,958 B1
(45) Date of Patent: Jul. 10, 2018

(54) LOCKS INSERTS AND LOCK ASSEMBLIES USING THEM

(71) Applicant: Robert Frydrych, Troutville, VA (US)

(72) Inventor: Robert Frydrych, Troutville, VA (US)

( * ) Notice: Subject to any disclaimer, the term of this patent is extended or adjusted under 35 U.S.C. 154(b) by 243 days.

(21) Appl. No.: 14/709,157

(22) Filed: May 11, 2015

Related U.S. Application Data

(60) Provisional application No. 61/991,954, filed on May 12, 2014.

(51) Int. Cl.
*E05B 11/00* (2006.01)
*E05B 11/02* (2006.01)

(52) U.S. Cl.
CPC ..... *E05B 11/02* (2013.01)

(58) Field of Classification Search
CPC ..... E05B 11/00; E05B 11/02
USPC ..... 70/377, 389, 390, 421, 429, 430, 492, 70/100, 367–369, 371, 360, 361, 379 R, 70/379 A, 380
See application file for complete search history.

(56) References Cited

U.S. PATENT DOCUMENTS 163,822 A * 5/1875 Stretcher ..... E05B 13/04 70/429
226,016 A * 3/1880 Barton ..... E05B 13/04 70/429
268,640 A * 12/1882 Dion ..... E05B 13/04 70/429
1,198,269 A * 9/1916 Polmann ..... E05B 13/04 70/430
1,508,571 A * 9/1924 O'Neill ..... E05B 17/188 70/429
1,698,761 A * 1/1929 Marsden ..... E05B 13/04 26/15 R
1,990,934 A * 2/1935 Falk ..... E05B 9/086 70/369
2,469,018 A * 5/1949 Swanson ..... E05B 11/00 70/389
2,517,480 A * 8/1950 Hagan ..... E05B 13/04 70/429
2,528,757 A * 11/1950 Kindler ..... E05B 17/185 70/429
2,531,865 A * 11/1950 Stanley ..... E05B 13/04 70/430
2,894,082 A * 7/1959 Collotta ..... H01H 27/06 200/43.08
3,102,411 A * 9/1963 Friedman ..... E05B 65/0864 292/62
3,578,371 A * 5/1971 Keller ..... E05B 29/00 70/377
3,699,790 A * 10/1972 Ansala ..... E05B 21/063 70/140
3,735,614 A * 5/1973 Keller-Volper ..... E05B 29/00 70/377
4,406,140 A * 9/1983 Wolter ..... F16B 41/005 70/231

(Continued)

*Primary Examiner* — Lloyd A Gall
(74) *Attorney, Agent, or Firm* — Rhodes IP PLC; Christopher R Rhodes

(57) ABSTRACT

Certain embodiments described herein are directed to lock inserts that are configured to prevent removal of a key from a lock assembly comprising the lock insert when the lock assembly is in an unlocked position. The lock insert can be configured to permit removal of the key when the lock assembly is in a locked position.

18 Claims, 9 Drawing Sheets

(56) References Cited

U.S. PATENT DOCUMENTS

| | | | | | |
|---|---|---|---|---|---|
| 4,458,513 | A * | 7/1984 | Reader | E05B 21/063 | 70/409 |
| 4,644,768 | A * | 2/1987 | Nowak | E05B 29/00 | 70/377 |
| 4,712,400 | A * | 12/1987 | Steinbach | E05B 9/086 | 70/369 |
| 5,184,490 | A * | 2/1993 | Takahashi | H01H 27/08 | 200/43.06 |
| 5,265,454 | A * | 11/1993 | Crocco | E05B 63/0065 | 70/101 |
| 5,335,520 | A * | 8/1994 | Lee | E05B 27/08 | 70/340 |
| 5,687,594 | A * | 11/1997 | Wang | E05B 29/004 | 70/358 |
| 5,970,762 | A * | 10/1999 | Myers | E05B 29/00 | 70/369 |
| 6,301,941 | B1 * | 10/2001 | Nicholsfigueiredo | E05B 13/04 | 292/150 |
| 7,975,518 | B2 * | 7/2011 | Chiang | E05B 29/004 | 70/383 |
| 8,438,886 | B2 * | 5/2013 | Bourgain | A47F 3/002 | 312/139.2 |
| 2005/0103072 | A1 * | 5/2005 | Lee | E05B 29/0033 | 70/492 |
| 2012/0186310 | A1 * | 7/2012 | Bacon | E05B 9/086 | 70/77 |
| 2012/0204611 | A1 * | 8/2012 | Chiou | E05B 9/084 | 70/369 |
| 2012/0266638 | A1 * | 10/2012 | Rao | E05B 19/0041 | 70/369 |

* cited by examiner

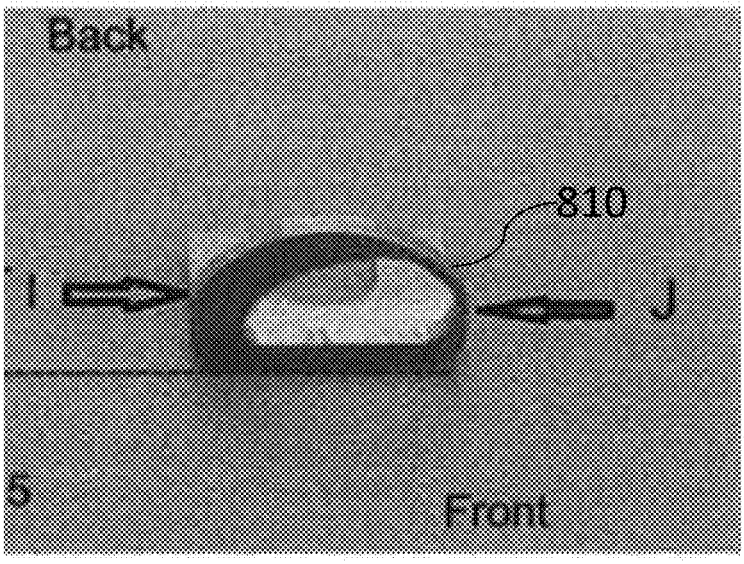
FIG. 11
FIG. 13A
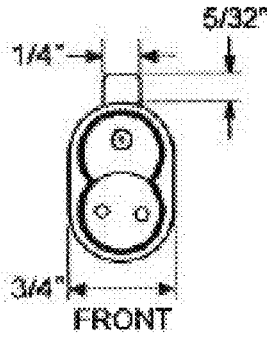
FIG. 13B
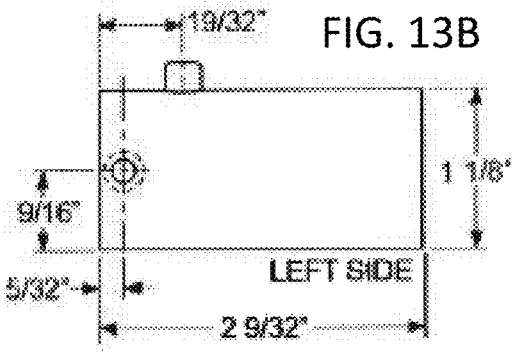
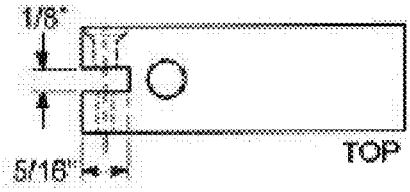
FIG. 13C

LOCKS INSERTS AND LOCK ASSEMBLIES USING THEM

This application is related to, and claims priority to, U.S. Provisional Application No. 61/991,954 filed on May 12, 2014, the entire disclosure of which is hereby incorporated herein by reference for all purposes.

BACKGROUND

Locks permit unwanted entry into cabinets, vehicles, buildings, residences and other dwellings or devices. For certain locks, the locks may remain unlocked after the key is removed from the lock.

SUMMARY

In certain aspects described herein, a lock insert configured to retain a key in various types of locks, e.g., a push lock, until the lock is actuated back to a locking position is described. For example, various different types of push locks, door locks, cylinder locks, etc. can be used with the lock insert and can be designed to retain the key when the lock is in the unlocked position. The lock insert may desirably be used in situations where security measures are needed for articles within a cabinet, vehicle, safe or other device. For example, jewelry cases, pharmaceutical cabinets, medicine carts, tool boxes, cargo carriers, panel trucks, sliding doors, lock boxes, gun cabinets, safes, radioactive material cabinets, and the like may be used with the lock inserts described herein. By retaining the key within the lock until the lock is locked, a person in charge of the cabinet or other device is motivated to lock the lock so the key can be removed.

In a first aspect, a lock insert configured to retain a key within a lock assembly is provided. In certain configurations, the lock insert comprises a first member orthogonally coupled to a second member and configured to be placed into a housing of the lock assembly to retain the key in the lock assembly housing when the lock assembly is in an unlocked position and configured to release the key with the lock assembly is in a locked position.

In certain embodiments, the first member comprises an asymmetrical inner cross-sectional shape comprising an aperture. In other embodiments, the first member comprises a substantially symmetrical outer cross-sectional shape that mirrors the cross-sectional shape of the housing. In further instances, the second member is configured to permit movement of a lock barrel of the lock assembly over the second member. In additional examples, the first member is configured with a substantially symmetric semi-circular outer cross section and an asymmetric inner cross section that provides an asymmetric aperture. In certain embodiments, the second member comprising legs configured to be positioned under a lock barrel when the lock barrel is in the locked position. In other embodiments, the lock insert is configured to be retained in a lock housing without the use of a set screw. In some examples, the first member and the second member independently comprises a plastic, a metal, a ceramic, and an elastomer. In further examples, the lock insert is configured for use with a push lock, a cylinder lock, a door lock, and a sliding panel lock.

In another aspect, a push lock comprising a housing, a barrel configured to insert into the housing and actuate between an unlocked position and a locked position, wherein in the unlocked position the barrel protrudes from the housing and in the locked position the barrel is flush with an outer face of the housing, the barrel comprising a keyhole, wherein the barrel can be pushed from the unlocked position to the locked position to lock the push lock, and a lock insert positioned internally within the housing and configured to retain a key within the keyhole of the barrel when the barrel is in the unlocked position and configured to permit release of the key when the barrel is in the locked position is described.

In certain examples, the insert comprises a symmetric outer body and an asymmetric inner body. In other examples, the barrel comprises an orthogonal pin that can actuate between a first position in the housing and a second position in the housing, in which the first position is the locked position and the second position is the unlocked position, wherein the insert is configured to retain the key in the keyhole when the orthogonal pin is in the second position. In additional embodiments, the barrel is configured to be retained within the housing when the key is used to lock and unlock the push lock and is configured to be removed from the housing using a second key. In some examples, the insert is sized and arranged to be positioned in the housing and behind the barrel and permit inward and outward movement of the barrel.

In an additional aspect, a cylinder lock configured to lock a device in a first position and to unlock a device after rotation of a lock cylinder to a second position, the cylindrical lock comprising a lock insert configured to retain a key within the keyhole of the lock cylinder when the lock cylinder is in the second position and configured to permit release of the key from the lock cylinder when the lock cylinder is in the first position is provided.

In certain examples, the insert comprises a symmetric outer body and an asymmetric inner body. In further examples, the cylinder comprises a spring-loaded pin that engages a locking position of a housing in the first position and disengages the locking position of the housing in the second position. In some embodiments, the cylinder is configured to be retained within a lock housing when the key is used to lock and unlock the lock and is configured to be removed from the lock housing using a second key. In certain embodiments, the insert is sized and arranged to be positioned in the housing and behind the cylinder and permit rotation of the cylinder.

In another aspect, a cabinet comprising at least one sliding door, and a push lock coupled to the at least one sliding door and configured to permit sliding of the at least one door in an unlocked position and prevent sliding of the door in a locked position, the push lock comprising a lock insert positioned internally within a housing and configured to retain a key within the keyhole of a barrel of the push lock when the barrel is in the unlocked position and configured to permit release of the key when the barrel is in the locked position is provided.

In certain embodiments, the insert comprises a symmetric outer body and an asymmetric inner body. In other embodiments, the push lock comprises an orthogonal pin that can actuate between a first position in the housing and a second position in the housing, in which the first position is the locked position and the second position is the unlocked position, wherein the insert is configured to retain the key in the keyhole when the orthogonal pin is in the second position. In certain examples, the cabinet further comprises a locking bar coupled to the push lock, the locking bar configured to prevent sliding of the sliding door when the push lock is in the locked position and permit sliding of the door when the push lock is in the unlocked position. In some examples, the cabinet is configured as a pharmaceutical cabinet, a tool box, a medicine cart, a jewelry display cabinet, a firearm display cabinet, an ammunition display cabinet, a file cabinet, a medical records cabinet, a radioactive material cabinet or a drawer.

In an additional aspect, a vehicle comprising a sliding panel door, a push lock coupled to the sliding panel door and configured to permit sliding of the panel door in an unlocked position and prevent sliding of the panel door in a locked position, the push lock comprising a lock insert positioned internally within a housing and configured to retain a key within the keyhole of a barrel of the push lock when the barrel is in the unlocked position and configured to permit release of the key when the barrel is in the locked position is disclosed.

In certain examples, the insert comprises a symmetric outer body and an asymmetric inner body. In other examples, the push lock comprises an orthogonal pin that can actuate between a first position in the housing and a second position in the housing, in which the first position is the locked position and the second position is the unlocked position, wherein the insert is configured to retain the key in the keyhole when the orthogonal pin is in the second position. In additional examples, the vehicle comprises a locking bar coupled to the push lock, the locking bar configured to prevent sliding of the panel door when the push lock is in the locked position and permit sliding of the panel door when the push lock is in the unlocked position. In some instances, the vehicle is configured as a military vehicle, an armored vehicle, a delivery vehicle, a mail vehicle, a helicopter, or an airplane.

In other aspects, a method of retaining a key within a lock, e.g., a push lock, is provided. In certain examples, the method comprises configuring the lock with a lock insert positioned in a housing of the lock, the lock insert configured to retain the key when a barrel or cylinder of the lock is in an unlocked position and to release the key when the barrel or cylinder of the lock is in a locked position.

In certain embodiments, the method comprises configuring the push lock insert to be positioned between the barrel and a back area of the housing when the barrel is installed in the housing. In other instances, the method comprises configuring the push lock insert with a first member and a second member, the first member configured to mate to a back surface of the housing and the second member configured to permit movement of the barrel over the second member. In certain examples, the method comprises configuring the first member to comprise an outer cross-section that mirrors the shape of the housing. In other embodiments, the second member is orthogonal to the first member. In some instances, the first member comprises a symmetrical outer cross-section and an asymmetrical inner cross section. In certain configurations, the method comprises configuring the insert to comprise at least one of a plastic, a metal, a ceramic, and an elastomer. In some embodiments, the method comprises configuring the push lock to couple to at least one locking bar. In certain examples, the method comprises configuring the barrel with a spring-loaded orthogonal pin configured to lock the lock when the spring-loaded pin couples to the housing at a locking position of the housing. In additional examples, the method comprises configuring the push lock to couple to a sliding door and prevent movement of the sliding door when the push lock is in the locked position and permit movement of the sliding door when the push lock is in the unlocked position.

In another aspect, a method of encouraging key removal from a lock is described. For example, the method comprises providing a lock insert configured to retain a key within the keyhole of a lock barrel (or a lock cylinder) in a lock housing when the lock barrel (or lock cylinder) is in the unlocked position and configured to permit release of the key when the lock barrel (or lock cylinder) is in the locked position.

In certain configurations, the method comprises configuring the lock insert with an outer cross-section that mirrors a shape of the lock housing and an asymmetrical inner cross-section. In other configurations, the method comprises sizing the lock insert to insert into the lock housing and be retained by the lock housing without the use of a set screw. In some instances, the method comprises configuring with a first member and a second member, in which the first member is orthogonal to the second member. In additional instances, the method comprises configuring the second member to permit movement of the lock barrel over the second member.

In an additional aspect, a method of encouraging key removal from a secured device comprising a push lock assembly, the method comprising providing a push lock for use with the secured device, the push lock comprising a lock insert positioned internally within a housing of the push lock and configured to retain a key within the keyhole of a lock barrel in the lock housing when the lock barrel is in the unlocked position and configured to permit release of the key when the lock barrel is in the locked position is provided.

In certain configurations, the method comprises configuring the secured device as one of a pharmaceutical cabinet, a medicine cart, a tool box, a jewelry cabinet, a firearm display cabinet, an ammunition display cabinet, a file cabinet, a medical records cabinet, a radioactive material cabinet or a drawer. In other instances, the method comprises configuring the secured device as one of a military vehicle, an armored vehicle, a delivery vehicle, a mail vehicle, a helicopter, or an airplane. In some examples, the method comprises configuring the key not to permit removal of the lock barrel from the lock housing to access the lock insert. In additional examples, the method comprises providing a second key configured to permit removal of the lock barrel from the lock housing to access the lock insert.

In another aspect, a kit comprising a lock insert configured to insert into a housing of a push lock assembly (or cylinder lock assembly), the lock insert configured to retain a key inserted into a keyhole of the push lock assembly (or cylinder lock assembly) when the lock assembly is in an unlocked position and configured to release the key when the lock assembly is in a locked position, and instructions for using the lock insert with a push lock assembly (or cylinder lock assembly) to configure the push lock assembly (or cylinder lock assembly) to retain the key when the lock assembly is in an unlocked assembly is described.

In certain configurations, the kit may comprise a key and/or a second key, in which the second key is configured to permit release of a lock barrel (or lock cylinder) from a lock housing and the key is not configured to permit release of the lock barrel (or lock cylinder) from the lock housing. In other instances, the kit comprises an additional lock insert, the additional lock insert configured to release the key inserted into a keyhole of the push lock assembly when the lock assembly is in an unlocked position and configured to release the key when the lock assembly is in a locked position. In some embodiments, the kit comprises a spacer configured to insert into a lock housing between the lock housing and the lock insert to position the lock insert in the lock housing. In certain examples, the lock insert is configured with an asymmetrical inner cross section and a substantially symmetric outer cross-section. In other examples, the kit comprises a lock housing configured to receive the lock insert. In some configurations, the kit comprises a lock barrel or lock cylinder configured to receive the key. In additional configurations, the lock insert is configured with a first member and a second member, in which the first member is orthogonal to the second member. In some embodiments, the lock insert comprise at least one of a metal, a plastic, a ceramic, and an elastomer.

In an additional aspect, a kit comprises a lock barrel (or lock cylinder), a lock housing configured to receive the lock barrel (or lock cylinder), and a lock insert configured to insert into the housing between a back portion of the housing and the lock barrel, in which the lock insert is configured to retain a key inserted into a keyhole of the push lock assembly when the lock assembly is in an unlocked position and configured to release the key when the lock assembly is in a locked position.

In certain embodiments, the kit may comprise a key and/or a second key, in which the second key is configured to permit release of the lock barrel (or lock cylinder) from the lock housing and the key is not configured to permit release of the lock barrel (or lock cylinder) from the lock housing. In other instances, the kit may comprise an additional lock insert configured to release the key inserted into a keyhole of the lock assembly when the lock assembly is in an unlocked position and configured to release the key when the lock assembly is in a locked position. In certain examples, the kit may comprise a spacer configured to insert into the housing between the housing and the lock insert to position the lock insert in the housing. In some configurations, the lock insert is configured with an asymmetrical inner cross section and a substantially symmetric outer cross-section. In other configurations, the lock insert is configured with a first member and a second member, in which the first member is orthogonal to the second member. In additional instances, the first member comprises an asymmetrical inner cross section and a substantially symmetric outer cross-section. In some examples, the second member is configured to permit sliding of the lock barrel over the second member to permit an orthogonal pin of the lock barrel to engage a locking position in the housing. In further embodiments, the lock insert comprises at least one of a metal, a plastic, a ceramic, and an elastomer.

Additional aspects, configurations, examples, embodiments and features are described in more detail below.

BRIEF DESCRIPTION OF THE SEVERAL VIEWS OF THE DRAWINGS

Certain configurations and aspects are described in more detail below in which:

FIGS. 9-11 are different views of the lock insert of FIG. 8A;

FIGS. 13A-13C are various illustrations showing certain dimensions of a lock assembly, in accordance with certain embodiments.

It will be recognized by the person of ordinary skill in the art, given the benefit of this disclosure, that the particular dimensions, sizes and arrangements of the components shown in the figures may vary depending on the intended use of the push lock insert, push lock and/or the components therein.

DETAILED DESCRIPTION

Certain configurations are described herein with reference to a push lock insert and its use in push locks. A push lock generally refers to any lock which can be locked by pushing some portion of the lock away from the user. To unlock the push lock, the user typically inserts a key into the push lock and turns the key, which results in ejection of a portion of the push lock outward from the lock assembly. As noted in more detail below, certain configurations described herein desirably include a push lock insert which is designed to retain the lock key until the push lock is pushed back into the lock position. The key may then be free for removal by the user.

Figure 1A:
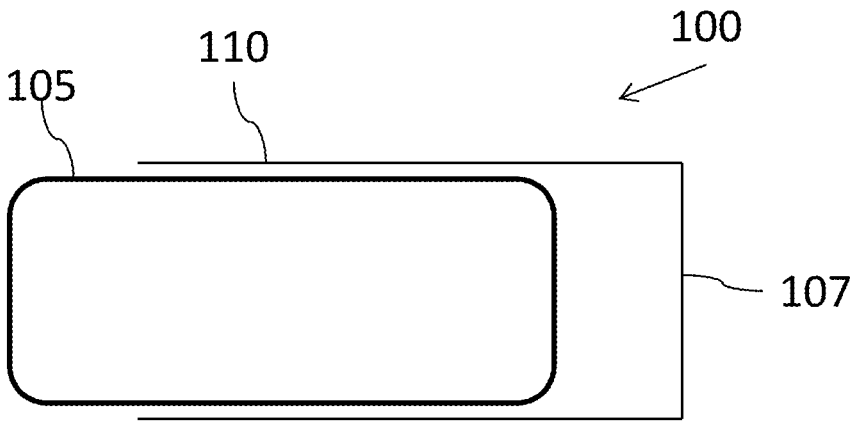
FIGS. 1A and 1B are cross-sections of a lock assembly, in accordance with certain configurations.
Figure 1B:
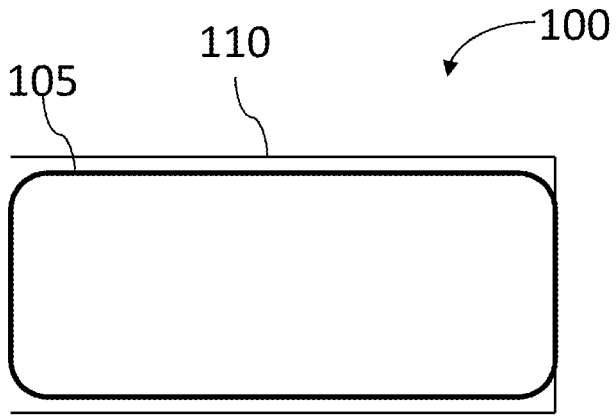

In certain configurations, a push lock insert may be designed to be inserted into a push lock assembly to capture a push lock key when the push lock is in the unlocked position. For example and referring to FIGS. 1A and 1B, a cross-section of a push lock 100 is shown. The push lock 100 comprises a housing 105, which is typically secured to the inside of an assembly through screws of bolts and a barrel 110 which can actuate outward to unlock the lock 100 (FIG. 1A) or inward to lock the lock 100 (FIG. 1B). The barrel 110 typically is spring loaded and comprises a locking pin or tumblers which can be used to lock and unlock the lock 100. For example, by inserting a key into the lock and turning the key, the locking pin can disengage from the locking position and permit the spring-loaded barrel 110 to pop out toward a user and unlock the lock 100. Popping of the spring loaded barrel out causes a proximal portion of the barrel 110 to move outward, which permits lateral movement of cabinet doors or other articles associated with the push lock 100. In certain embodiments as described in more detail below, a lock insert may be present at a distal end 107 of the housing 105 such that popping out of the barrel 110 of the lock 100 unlocks the lock 100 but retains the key in the lock 100. The key is retained until the barrel 110 is depressed back into the housing 105 to lock the lock 100. The key may then be released and removed from the lock 100.

Figure 2A:
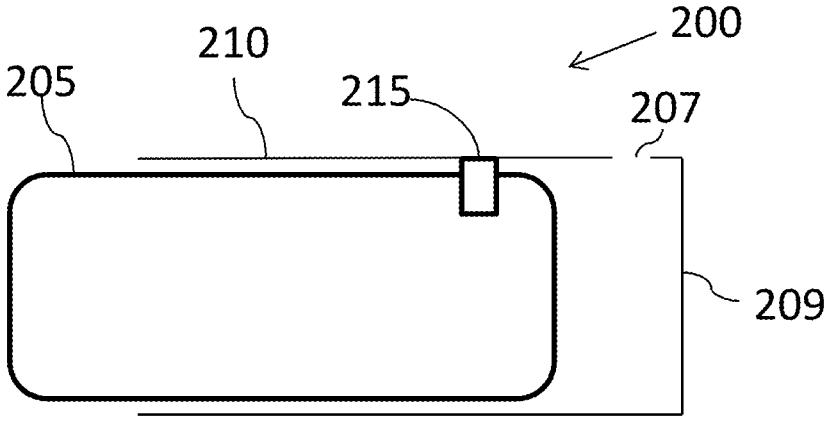
FIGS. 2A and 2B are cross-sections of a lock assembly comprising a locking pin, in accordance with certain configurations.
Figure 2B:
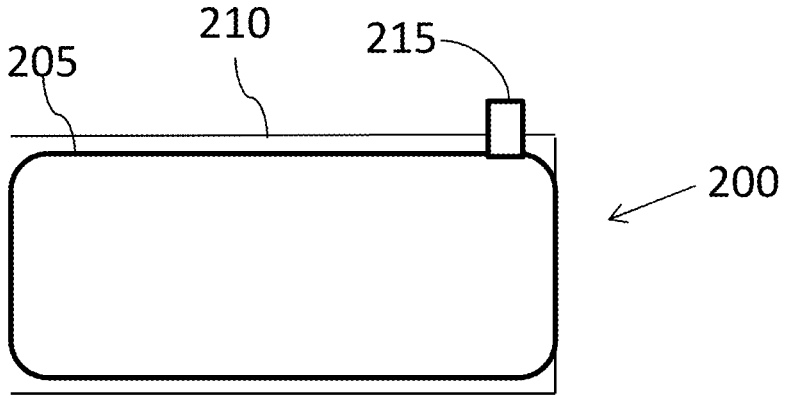

In certain configurations, the barrel may comprise a vertical locking rod that acts to retain the lock in the locked position and/or the unlocked position. Referring to FIGS. 2A and 2B, a lock assembly 200 comprises a housing 205 and a barrel 210. In the unlocked position (FIG. 2A), a vertical locking rod 215, which is generally positioned orthogonal to the longitudinal axis of the barrel 210 and may comprise a spring to permit actuation of the locking rod 215 radially, may be pressed against an inner portion of the housing 205. Pressing the barrel 210 inward toward the back of the housing 205 (see FIG. 2B) causes the barrel 210 to slide until the vertical locking rod 215 moves radially and engages a slot or aperture 207 in the upper portion of the housing 205. Engagement of the rod 215 in the aperture 205 lock the barrel into the closed position shown in FIG. 2B and locks any articles coupled to the lock 200 in the locked position. For example, where the lock 200 is coupled to one or more cabinet doors or sliding doors, when the lock 200 is in the position shown in FIG. 2B, the doors may not be opened. When the lock 200 is moved to the position shown in FIG. 2A, lateral movement (or up and down movement or movement in other directions) of the doors is permissible. In certain embodiments as described in more detail below, a lock insert may be present at a distal end 209 of the housing 205 such that popping out of the barrel 210 of the lock 200 unlocks the lock 200 but retains the key in the lock 200. The key is retained until the barrel 210 is depressed back into the housing 205 to permit engagement of the locking rod 215 with the aperture 207 to lock the lock 200. The key may then be released and removed from the lock 200.

Figure 3A:
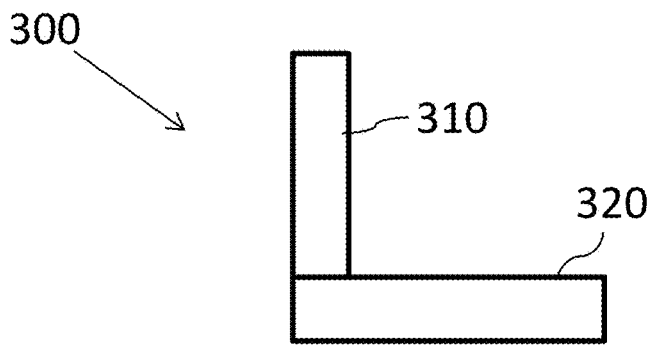
FIGS. 3A-3C are illustrations of a lock insert, in accordance with certain embodiments.
Figure 3B:
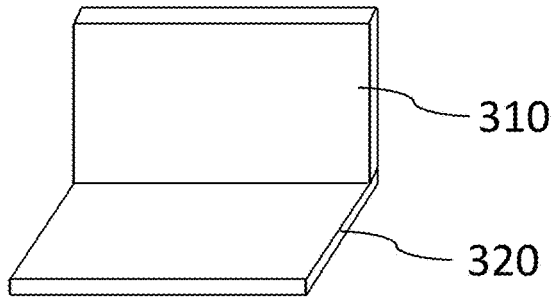
Figure 3C:
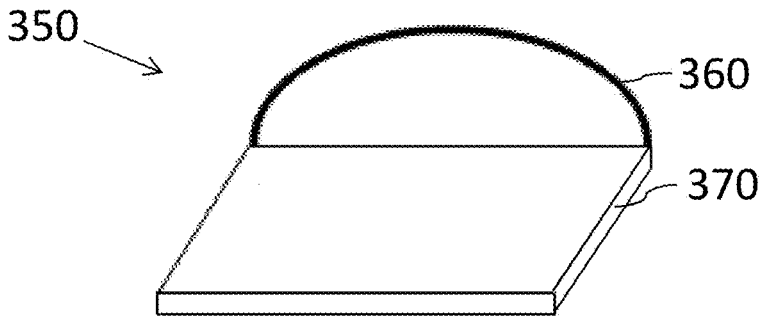

In certain configurations, a lock insert may be configured with a first member coupled to a second member in a generally orthogonal manner, the insert configured to be inserted into a locking device to prohibit removal of the key from the locking device unless the locking device is in the locked position. For example, the first member may be a vertically protruding member, and the second member may be perpendicular to the first member and designed to position the first member appropriately in the housing of the lock. Referring to FIGS. 3A and 3B, a lock insert 300 is shown comprising a first member 310 and a second member 320 coupled to the first member at about 90 degrees to the first member 310. While the insert is described herein as comprising a first member and a second member, the two members are typically present in an integral insert without any joint or coupling between them. For ease of describing how the various portions of the insert function, the inserts are described herein as comprising a first member and a second member. In use, the first member 310 is positioned against a back portion of the housing of the lock assembly behind the barrel. The member 320 is typically positioned underneath the barrel such that the barrel (when pressed in to lock the lock) slides over some portion of the second member 320. While the members 310, 320 are shown pictorially as rectangular, the outer surfaces of one or both of the members may take the general shape of the housing of the lock to permit insertion of the insert into the housing and retention by the housing. For example and referring to FIG. 3C, an insert 350 comprises a first member 360 with a generally semi-circular shape which mirrors a lock housing shape and a second member 370 designed to rest substantially flat against a surface of the housing. Where the lock housing takes the shape of an oval, the first member may be oval shaped and inserted into the outer face of the housing. The asymmetric shape of the housing can act to retain the insert in a proper position without the need to use a set screw or other retention device. The second member 370 can be configured to permit movement of a lock barrel over it during depression of the lock barrel or may permit rotation of a lock cylinder over the second member where the lock assembly comprises a lock cylinder. The second member 370 may be configured to retain the first member 360 in a desired orientation within the housing of the lock assembly.

Figure 4:
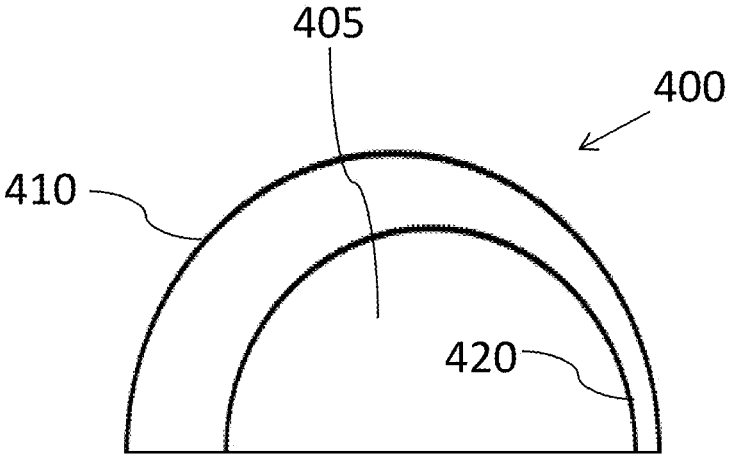
FIG. 4 is an illustration of one portion of a lock insert, in accordance with certain configurations.

In certain embodiments, the first member of the insert may comprise a suitable inner and outer geometry to function with the barrel assembly to retain the key when the barrel is in the unlocked position. To retain the key within the barrel, the first member may comprise an asymmetric inner cross-section that is configured to permit capturing of the key by the keyhole of the barrel. For example, one or more pins, cams or gears of the barrel assembly may engage the key when the barrel is in the unlocked position and prevent removal of the key. Depression of the barrel may cause the pins, cams or gears to move away from the key and permit removal of the key from the keyhole. Referring to FIG. 4, an illustration of a first member of a lock insert is shown. The member 400 comprises a generally semi-circular outer cross-section 410 and an asymmetric inner cross section 420. The asymmetric nature of the inner cross-section 420 can function to permit key retention when the barrel is in the unlocked position. The barrel or cylinder may comprise a tail piece that receives pressure from the asymmetric insert to lock the key within the barrel when the lock is in the unlocked position. When the lock is moved to the lock position, then the pressure on the tail piece can be relieved, which permits removal of the key. While the exact dimensions and overall geometry of the inner cross-section may vary, the inner cross-section typically comprises an asymmetric semi-circle with increased face thickness in one or more areas. For example, in the representation of FIG. 4, the face thickness toward the right of the figure is decreased compared to the face thickness on the left of the figure. A central aperture 405 is present in the insert and comprises open space such that a barrel or cylinder feature is permitted to pass through the insert. For example, one or more locking features may interact with the back of the barrel to lock the device coupled to the lock in place. The exact locking features may vary, and in certain instances, the locking features comprise locking bars that prevent side to side or up to down movement of the device coupled to the lock. For example, in instances where the device comprises sliding doors a locking bar may be present to prevent sliding of the doors from side to side when the barrel is in the depressed position.

In certain embodiments, the outer cross-section 410 of the insert 400 may mirror the inner cross-section of the housing. For example, the insert 400 may be inserted into the lock housing by removing the barrel and then placing the insert 400 into the inner space of the housing until it contacts a back surface of the housing. The barrel may then be reinserted into the housing and acts to retain the insert in place. In some example, the insert may be sized about a few thousandths of an inch smaller than the inner dimension of the housing to permit insertion but to deter too much movement of the insert within the housing. In other embodiments, the insert may be friction fit into the housing by depressing and/or slight bending of the insert until it is positioned substantially flush against the back surface of the housing. In other instances, an adhesive may be used to retain the insert at the back of the housing. In further instances, a set screw or other retention device may be inserted into the housing to retain the insert in place, whereas in other configurations the insert is configured to be retained without the use of a set screw.

Figure 5:
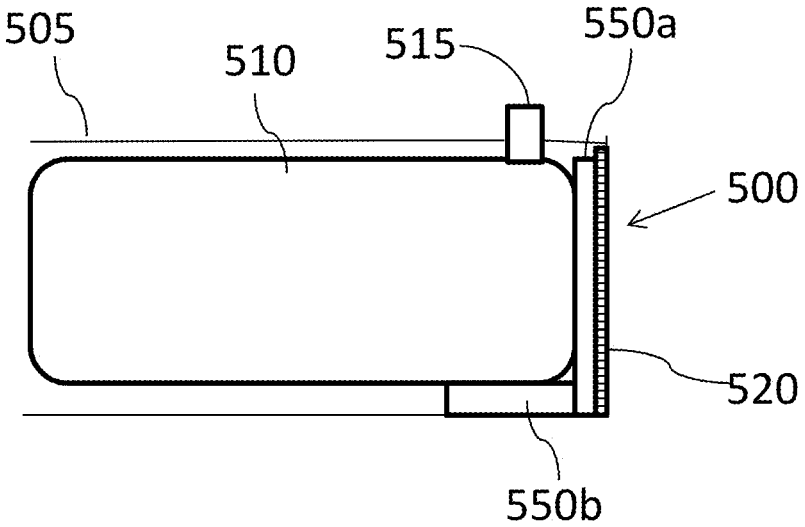
FIG. 5 is an illustration of a lock assembly comprising a lock insert, in accordance with certain examples.

In some instances, a spacer may be placed between the rear of the lock housing and the insert to position the insert a suitable distance away from the housing and permit proper use of the insert with the lock barrel or cylinder. Referring to FIG. 5, a lock assembly 500 is shown with a lock housing 505 and a barrel or cylinder 510 within the housing 505. A lock pin 515 is shown as locking the lock into the lock position (which permits key removal). A spacer 520 and insert (collectively 550*a*, 550*b*) are shown as being position in the back of the housing 505. The spacer 520 may be rigid or may be compressible. As shown in FIG. 5, the second member 550*b* is configured to permit the barrel or cylinder 510 to slide over it and/or rotate over it. The dimensions of the second member are desirably not so large to interfere with movement of the barrel or cylinder 510 during operation of the lock 500. As noted in more detail below, the second member may be configured with a tapered thickness and/or legs or projections to permit lock barrel or cylinder function and permit retention of the lock insert in a desired position.

In certain configurations, the lock inserts described herein typically are machined or produced from similar materials used to produce the lock housing and/or lock cylinder or barrel. For example, the lock insert may be machined from metal and bent into position to provide the first member and the second member. A suitable amount of material can be removed from the first member to provide an asymmetric aperture. Similarly, a suitable amount of material can be removed from the second member to permit the cylinder or barrel to still function properly in the lock. In some instances, the insert may be produced by molding processes using a plastic, e.g., reinforced plastics such as thermoplastics and/or thermosetting materials, to provide low cost inserts with sufficient strength. In other instances, hardened materials, ceramics and the like can be used to provide added strength to the insert to avoid breaking or bending of the insert within the assembly. To provide compressibility and enhanced locking of the barrel or cylinder in a tight manner, the insert may comprise an elastomeric material or coating which compresses against the back of the barrel or cylinder. Other materials and coatings may also be used with the lock inserts.

Figure 6:
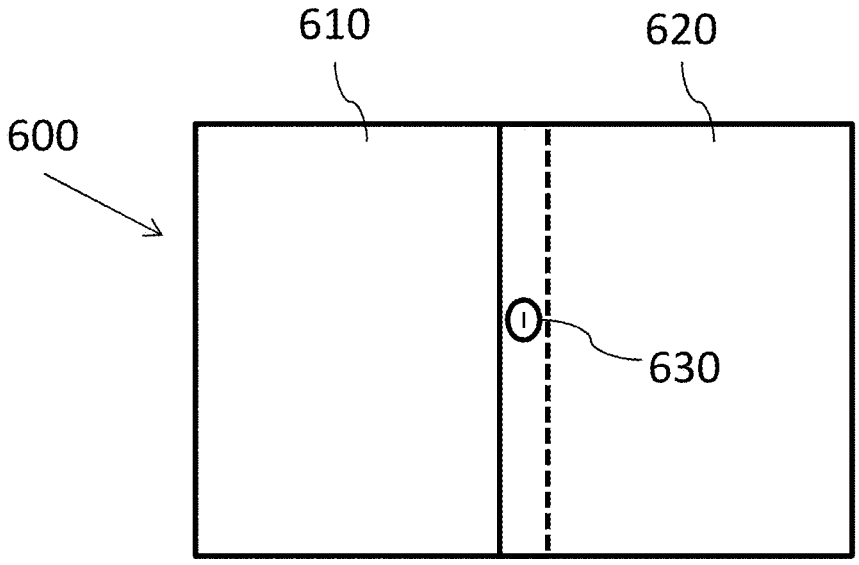
FIG. 6 is an illustration of a cabinet comprising a sliding door, in accordance with certain embodiments.

In certain configurations, the lock inserts described herein may be used with a cabinet, drawer or other device that comprises a sliding component. For example, a cabinet with a sliding door, a drawer that slides in and out, a pharmaceutical cabinet designed to retain regulated drugs, a jewelry display cabinet comprising valuable items, a firearm display cabinet, an ammunition display cabinet, a file cabinet, a medical records cabinet, a radioactive material cabinet or other cabinets that retain items which may need to be secured may be used with the lock inserts described herein. Referring to FIG. 6, a cabinet 600 is shown comprising sliding doors 610, 620 and a lock assembly 630. The lock assembly 630 may be coupled to locking bars which prevent the doors 610, 620 from moving when the lock 630 is in the locked position. The lock 630 can be configured as a cylinder lock (where the cylinder rotates to lock and unlock the lock 630) or a push lock (where the barrel is depressed to lock the lock and pops out when the lock is unlocked). The lock 630 comprises a lock insert positioned internally within a housing such that the lock 630 is configured to retain a key within the keyhole of a lock in the unlocked position and to permit release of the key when the lock is in the locked position. In the unlocked position, the doors 610, 620 may slide left to right, right to left, up to down or down to up. As noted herein, the lock insert of the cabinet 600 typically comprises a symmetric outer body and an asymmetric inner body. The lock 630 may comprise an orthogonal pin that can actuate between a first position in the housing and a second position in the housing, in which the first position is the locked position and the second position is the unlocked position, wherein the insert is configured to retain the key in the keyhole when the orthogonal pin is in the second position. Locking features other than locking pins and locking bars may also be used if desired.

Figure 7:
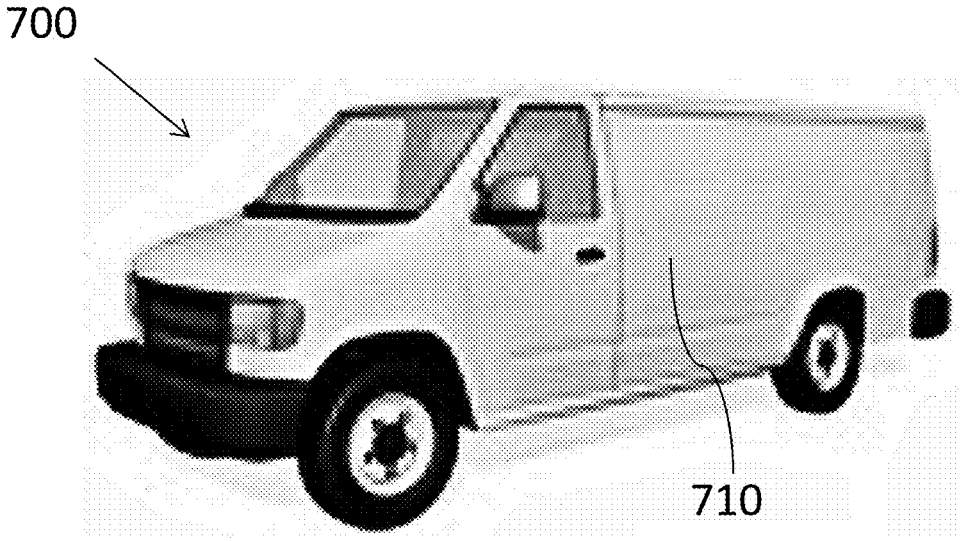
FIG. 7 is an illustration of a vehicle comprising a sliding door, in accordance with certain embodiments.

In certain embodiments, the lock inserts described herein may be used in vehicles that contain items to be secured. For example, a military vehicle (e.g., tank, armored personnel carrier, troop transport, etc.), an armored vehicle (e.g., those transporting money, gold, prisoners, etc.), a delivery vehicle (e.g., a vehicle delivering packages, freight or other shipped goods and articles), a mail vehicle, a helicopter or an airplane or other aircraft that may include a sliding door can include one or more of the lock inserts described herein. Use of the lock inserts described herein in such vehicles prevents the user from locking their keys in the vehicle and also encourages the user to lock the doors prior to leaving the vehicle unattended as the user is unable to remove their keys from the lock until the door is in the locked position. Referring to FIG. 7, a van 700 comprising a sliding side door 710 is shown. The van door 710 may be configured with a lock comprising a lock insert as described herein such that a key cannot be removed from the lock of the door 710 until the door is in the locked position. The lock insert present in the lock of the van 700 may take many configurations, e.g., may comprise a symmetric outer body and an asymmetric inner body. The exact locking mechanism used may also vary, e.g., may comprise a locking bar, pins, tumblers, an orthogonal pin that can actuate between a first position in the housing and a second position in the housing, in which the first position is the locked position and the second position is the unlocked position, wherein the insert is configured to retain the key in the keyhole when the orthogonal pin is in the second position, etc.

In certain embodiments, the lock inserts described herein may be packaged into a kit. For example, the kit may comprise a lock insert configured to insert into a housing of a push lock assembly (or a cylinder lock assembly), the lock insert configured to retain a key inserted into a keyhole of the push lock assembly (or cylinder lock assembly) when the lock assembly is in an unlocked position and configured to release the key when the lock assembly is in a locked position. The kit may include instructions for using the lock insert with a push lock assembly, cylinder lock assembly or other type of lock assembly to configure the lock assembly to retain the key when the lock assembly is in an unlocked assembly. An end user may retrofit an existing lock with the lock insert, may install the lock insert into a new lock with a modified lock housing (as noted in more detail below) or may modify an existing lock housing to install the lock insert. In some instances, the kit may also comprise a key to lock and unlock the lock. In other configuration, a master key or second key may be present in the kit. The second key may, for example, lock and unlock the lock as well as permit release of a lock barrel or cylinder from a lock housing. In some instances, the lock kit may comprise more than a single lock insert. For example, an additional lock insert configured to release the key inserted into a keyhole of the push lock assembly when the lock assembly is in an unlocked position and configured to release the key when the lock assembly is in a locked position may be present so an end user can decide which insert to install into the lock housing. The lock kit may also include one or more spacer, a lock barrel, a lock cylinder, a lock housing, housing screws or fasteners, a drilling template or other features to facilitate installation of a lock into a cabinet, vehicle or other article or device.

In certain examples, the lock inserts described herein may be used to configure a push lock with a lock insert positioned in a housing of the push lock to retain the key when a barrel of the push lock is in an unlocked position and to release the key when the barrel of the push lock is in a locked position. In some instances, the push lock insert is configured to be positioned between the barrel and a back area of the housing when the barrel is installed in the housing. In other instances, the push lock insert is configured with a first member and a second member, the first member configured to mate to a back surface of the housing and the second member configured to permit movement of the barrel over the second member. In some embodiments, the first member is configured to comprise an outer cross-section that mirrors the shape of the housing and/or the second member is orthogonal to the first member. In other instances, the first member comprises a symmetrical outer cross-section and an asymmetrical inner cross section.

In some instances, the lock inserts described herein may encourage locking and key removal. For example, by providing a lock insert configured to retain a key within the keyhole of a lock barrel in a lock housing when the lock barrel is in the unlocked position and configured to permit release of the key when the lock barrel is in the locked position, a user may not remove their keys from the lock until the lock is in the locked position. This configuration reduces the likelihood that secure cabinets and articles are left in an unlocked position. For existing push lock assemblies, key removal in the unlocked position often results in the cabinet being unsecure and permitting unwanted access by third parties.

Certain specific configurations of a lock insert and lock assembly are provided to better describe some novel aspects and configurations.

Example 1

Figure 8A:
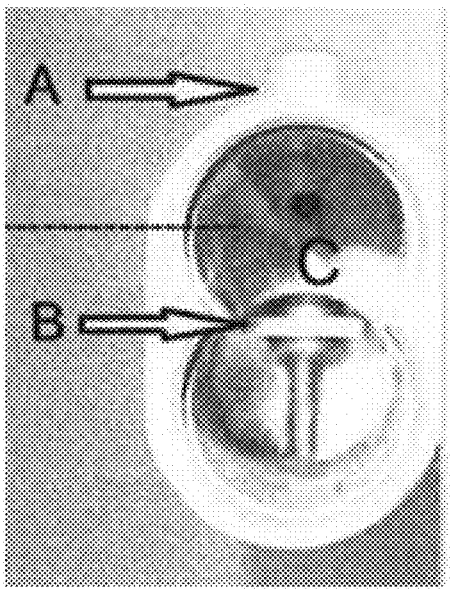
FIG. 8A is front view of a lock housing and FIG. 8B is a view of a lock insert that can be inserted into the housing of FIG. 8A.
Figure 8B:
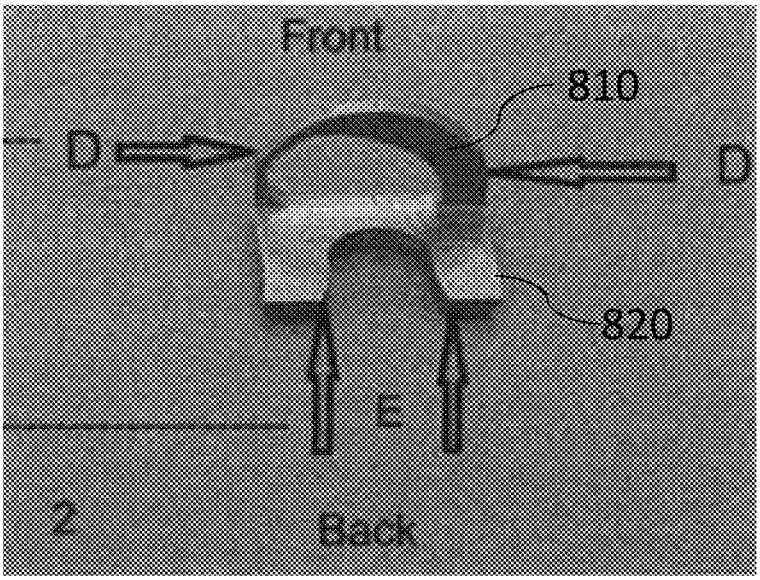

A lock insert (FIG. 8B) for use with a push lock assembly (FIG. 8A) can include a first member 810 with a face width of about 0.459 inches (labeled as "D" in FIG. 8B). A second member 820 includes an inside cut width of about 0.196 inches (labeled as "E" in FIG. 8B). The lock insert can be inserted into a lock housing (see FIG. 8A) that has been modified to receive the insert. The lock housing of FIG. 8A is designed to receive a push lock barrel having a figure eight shape, which typically is inserted into the housing after the lock insert of FIG. 8B is inserted into the back of the housing. A vertical locking rod or pin (labeled as "A" in FIG. 8A) may be present in the housing and may engage a physical structure to hold the lock in the locked position. An inner surface of the housing (labeled as "C" in FIG. 8A) can be modified to a radius height of about 0.285 inches to permit insertion of the insert into the housing. A retracting flat bar (labeled as "B" in FIG. 8A) may also be present within the housing if desired or can be packaged with a kit so that a user can decide whether to configure a lock with a barrel or cylinder which permits removal of a key in the open and closed position or configure the lock with an insert to prevent key removal when the lock is in the unlocked position.

Figure 9:
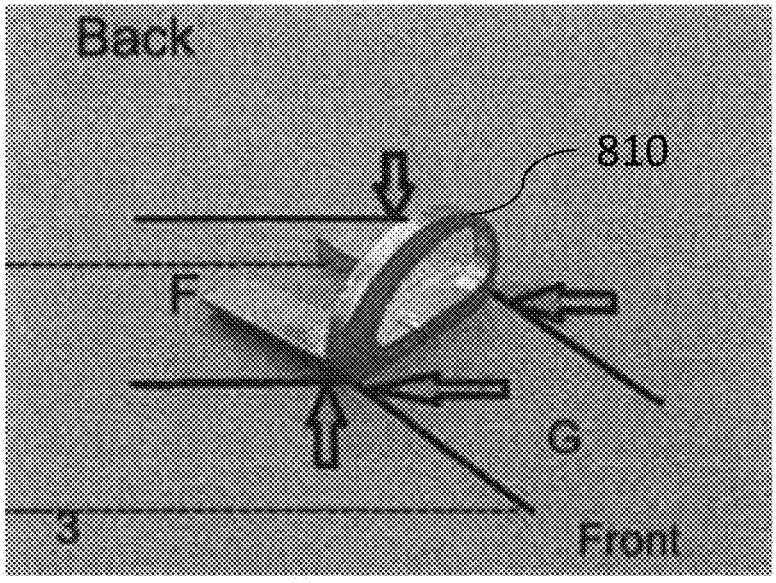
Figure 10:
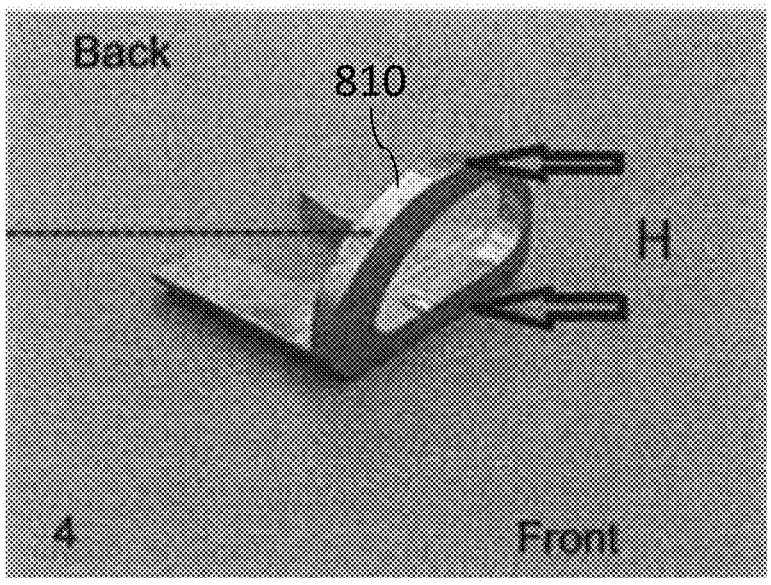

FIGS. 9 and 10 show different views of the lock insert of FIG. 8B. The insert comprises an inside center width of 0.150 inches (labeled as "F" in FIG. 9) and an outside base of 0.450 inches (labeled as "G" in FIG. 9). The top to bottom height H of the first member 810 is about 0.270 inches.

FIG. 11 shows the asymmetric nature of the first member 810. The left side crown wall (labeled as "I" in FIG. 11) is about 0.085 inches thick, and the right side crown wall (labeled as "J" in FIG. 11) is about 0.035 inches thick. As noted herein, the asymmetric nature of the insert permits pressure to be provided on the barrel of the lock to retain the key when the lock is in the unlocked position.

Figure 12A:
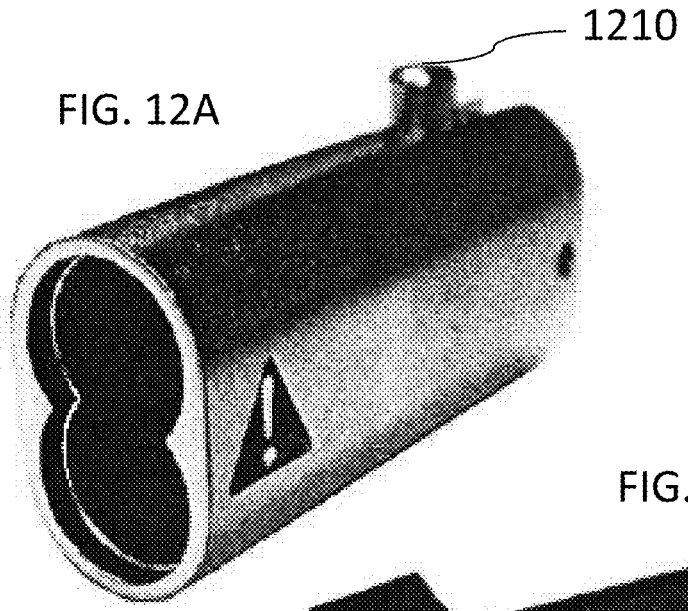
FIGS. 12A-12C are views of components that can be present in a lock kit.
Figure 12B:
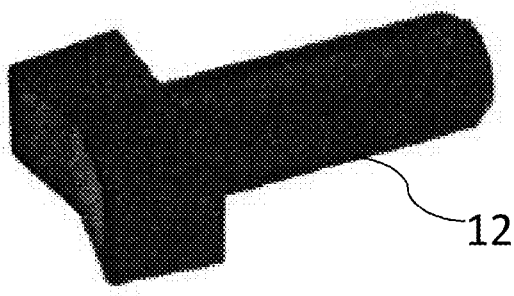
Figure 12C:
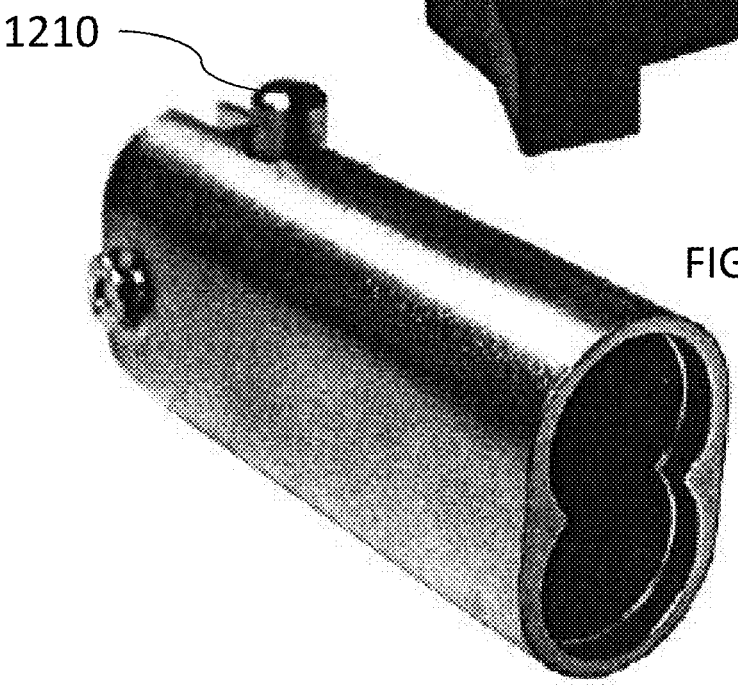

FIGS. 12A and 12C show the lock housing which comprises a vertical spring loaded locking pin 1210 which can engage a metal bar or other feature of a device to lock the lock. When the lock is in the unlocked position, the pin 1210 is typically retracted and is biased against an inner surface of the housing. An installation tool 1220 may be present in a kit to test the installation of the housing. For example, the tool 1220 can be inserted into the housing after insertion of an insert to test that the lock is functioning properly even where no barrel or cylinder is present.

FIGS. 13A-13C show various dimensions of a lock housing. Referring to FIG. 13A, the housing may comprise an outside width of about ¾ inches and include a vertical locking pin with a diameter of about ¼ inch and a protruding height (in the locked position) of about 5⁄32. The distance from the pin to the back of the housing (see FIG. 13B) may be about 19⁄32 inches, the height of the lock housing may be 1⅛ inches and the overall length of the lock housing may be 2⁹⁄₃₂ inches. FIG. 13C shows a slot of about ⅛ inches where, for example, a tail piece or other feature of the barrel may engage and disengage an insert position behind the lock housing. The length of the slot may be, for example, about 5⁄16 inches.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A lock assembly comprising a key, a housing, and a barrel, wherein the housing is configured to receive the barrel and a lock insert and wherein the housing comprises a spring-loaded vertical locking pin that is retracted and biased against an inner surface of the housing when the barrel is in an unlocked position and protrudes from the housing when the barrel is in a locked position to lock the lock assembly, wherein the barrel comprises a slot configured to receive the key, wherein the lock insert is inserted into an opening in the housing until it engages a back surface of the housing so a first member of the lock insert contacts the back surface of the housing and a second member of the lock insert comprises projections that receive the barrel when the barrel is in the locked position, wherein the first member of the lock insert is coupled to the second member of the lock insert at an orthogonal angle, wherein the first member of the lock insert comprises an aperture comprising an asymmetrical inner cross-sectional shape and a symmetric outer cross-sectional shape that mirrors a cross-sectional shape of the opening in the housing, wherein the lock insert is configured to exert pressure on a tail piece of the barrel to lock the key in the slot of the barrel when the barrel is in the unlocked position, wherein the asymmetrical inner cross sectional shape of the lock insert is configured to permit release of the key from the slot of the barrel when the barrel is in the locked position.

2. The lock assembly of claim 1, in which a thickness of the first member comprising the asymmetrical inner cross-sectional shape is about 0.085 inches thick at a left side crown wall and about 0.035 inches thick at a right side crown wall.

3. The lock assembly of claim 1, in which a face width of the first member is about 0.0459 inches and an inside cut width between the projections of the second member is about 0.196 inches wide.

4. The lock assembly of claim 3, in which an outside base width of the first member is about 0.450 inches and an inside center width of the first member is about 0.150 inches.

5. The lock assembly of claim 1, in which the first member of the lock insert has a top to bottom height of about 0.270 inches.

6. The lock assembly of claim 1, in which the projections of the second member are configured to be positioned under the barrel when the barrel is in the locked position.

7. The lock assembly of claim 1, in which the lock insert is configured to be retained in the housing without the use of a set screw.

8. The lock assembly of claim 1, in which each of the first member and the second member of the lock insert independently comprises a plastic, a metal, a ceramic, or an elastomer.

9. The lock assembly of claim 1, in which the lock assembly is configured as a spring loaded push lock.

10. The lock assembly of claim 1, wherein the spring-loaded vertical locking pin is configured to engage a metal bar on a device to be locked to lock the device.

11. The lock assembly of claim 1, further comprising an installation tool configured to insert into the housing in place of the barrel to test if the lock is functioning properly when no barrel is present.

12. The lock assembly of claim 1, wherein the housing comprises a figure eight shape that mirrors a figure eight shape of the barrel.

13. The lock assembly of claim 1, further comprising a retracting flat bar configured to insert in the housing.

14. The lock assembly of claim 1, wherein the housing is configured to receive the lock insert through a friction fit by depressing of the lock insert until it is positioned substantially flush against the back surface of the housing.

15. The lock assembly of claim 1, wherein an adhesive is present between the lock insert and the back surface of the housing to retain the lock insert in the housing.

16. The lock assembly of claim 1, further comprising a spacer configured to insert between the back surface of the housing and the lock insert to position the lock insert away from the back surface of the housing.

17. The lock assembly of claim 1, wherein the barrel is configured to rotate over the second member when the barrel is moved between the locked position and the unlocked position.

18. The lock assembly of claim 1, wherein the barrel is configured to push into the housing of the lock assembly in the locked position to lock the lock assembly and permit removal of the key, and wherein the barrel is configured to protrude from the housing of the lock assembly in the unlocked position.

* * * * *